US007017992B2

(12) United States Patent
Stumpf

(10) Patent No.: US 7,017,992 B2
(45) Date of Patent: Mar. 28, 2006

(54) CHAIR CONTROL DEVICE FOR A TILTABLE CHAIR

(75) Inventor: William Stumpf, Kitchener (CA)

(73) Assignee: Warvel Products, Inc.-N.C., Mooresville, NC (US)

( * ) Notice: Subject to any disclaimer, the term of this patent is extended or adjusted under 35 U.S.C. 154(b) by 0 days.

(21) Appl. No.: 10/368,691

(22) Filed: Feb. 18, 2003

(65) Prior Publication Data

US 2004/0160102 A1 Aug. 19, 2004

(51) Int. Cl.
*A47C 1/032* (2006.01)

(52) U.S. Cl. ..... 297/301.7; 297/374; 297/302.4; 297/302.7

(58) Field of Classification Search ..... 297/300.1, 297/300.2, 300.5, 301.1, 301.7, 302.1, 303.5, 297/374, 302.4
See application file for complete search history.

(56) References Cited

U.S. PATENT DOCUMENTS

| | | | |
|---|---|---|---|
| 4,013,258 | A | 3/1977 | Doerner |
| 4,014,086 | A | 3/1977 | Doerner |
| D246,217 | S | 11/1977 | Doerner |
| D246,588 | S | 12/1977 | Ferrarell |
| D247,943 | S | 5/1978 | Doerner |
| 4,123,103 | A | 10/1978 | Doerner |
| D252,786 | S | 9/1979 | Doerner |
| 4,253,632 | A | 3/1981 | Doerner |
| D278,961 | S | 5/1985 | Doerner |
| 4,636,004 | A | 1/1987 | Neumuller |
| 5,356,200 | A | 10/1994 | Stumpf et al. |

(Continued)

FOREIGN PATENT DOCUMENTS

EP 0 972 469 A 1/2000

*Primary Examiner*—Peter R. Brown
(74) *Attorney, Agent, or Firm*—Smith Moore LLP

(57) ABSTRACT

A chair control device for a tiltable chair wherein the chair control includes a a one-piece integral structure mainframe housing, including an integral extension for a seat locking cam means, for supporting adjustment mechanisms. The housing is affixed to the underside of a seat portion of a chair and, optionally, a tailpiece bracket to affix the mainframe to a back portion of the chair. Also included in the device is a tension control means to control the resistance of the tilt motion, the tension control includes an elongated bolt having a first end attached to the mainframe and a second end attached to an adjustment means. A compression spring is inserted on the shaft of the bolt between the adjustment means and the mainframe. The tension control means is adapted to control the tension of the compression spring. A seat locking cam to control the amount of tilt in a specific range by locking of the seat, includes a clutch means to control the tilt function to lock the tilt into position and an adjustment means affixed to the locking cam clutch and a release means for the back portion of the chair including a clutch means to control the position of the back and an adjustment means affixed to the release clutch.

7 Claims, 3 Drawing Sheets

U.S. PATENT DOCUMENTS 5,423,594 A * 6/1995 Hancock et al. ..... 297/300.2
5,423,595 A * 6/1995 Hancock ..... 297/374
5,447,357 A * 9/1995 Dauphin ..... 297/301.4
5,588,706 A * 12/1996 Neumueller et al. ..... 297/374
5,658,045 A 8/1997 Van Koolwijk
5,664,834 A * 9/1997 Hsu ..... 297/300.1
6,010,189 A 1/2000 Hybarger et al.
6,120,096 A 9/2000 Miotto
6,131,998 A * 10/2000 Su ..... 297/374
6,394,550 B1 * 5/2002 Liu ..... 297/374
6,447,063 B1 * 9/2002 Beggs ..... 297/300.5
6,467,845 B1 * 10/2002 Chen ..... 297/374

* cited by examiner

CHAIR CONTROL DEVICE FOR A TILTABLE CHAIR

BACKGROUND OF THE INVENTION

1. Field of the Invention

This invention relates generally to tiltable chairs and in particular a mechanical device particularly useable for the movement and selective locking of a chair.

2. Description of the Prior Art

Tiltable chairs of the prior art generally consist of a seat portion, a back portion, a chair control device and a base portion. The chair control device pivotally connects the base portion of the chair to the seat portion and allows the tilting of a part of the chair in a rearwards and backwards direction when rearward pressure is applied to the back portion of the chair by the person seated in the chair. The chair control is adapted to return the tilting portion when this pressure is released.

These chair control device consist of a fixed frame housing secured to the base portion of the chair, a movable frame portion secured to the tilting portion of the chair (either the seat of the back of the chair) and a biasing means which pivotally connects the fixed frame portion to the resting portion thereby allowing the seat or the back of the chair to be tilted. It is known that the fixed frame housing of the prior art are made up of several components that are affixed together by welding and other means such as bolting the parts together. One area of recurring failure of the existing housings used in tiltable chairs is the extension for the seat locking cam means that is welded onto the housing. Due to the forces of recurring use, the extension often breaks at or near the portion welded to the housing.

The biasing means usually includes an elongated bolt that extends from the interior of the fixed frame portion through the moveable frame portion and marginally beyond. The head of the bolt is placed in the fixed frame portion and a slot or groove is provided in the vertical wall of the fixed frame portion in which the head of the bolt may pivot. The shaft of the bolt extends through the fixed frame portion, through the length of the moveable frame portion and marginally beyond.

A helical compression spring is inserted on that portion of the bolt within the moveable frame portion and the interior end of this spring contacts with the interior vertical wall of the moveable frame portion. A tension control means is inserted on the free end of the bolt. This tension control means usually comprises a pressure plate in contact with the spring, a short sheath about the bolt and affixed to the pressure plate and extending outwards to a hand wheel. The interior of the sheath is screw-threaded corresponding to the screw threading on the end of the bolt.

In order to create tension in the spring, the hand wheel is tightened thereby causing the pressure plate to move inwards contracting the helical spring. Thus, by moving the position of the hand wheel, the amount of tension in the spring may be increased of reduced.

When the user of the chair applies downward pressure to the back portion of the chair, the fixed frame portion moves upward thereby causing the seat and back portions of the chair to tilt rearwards. The tension in the helical spring will cause the device to pivot back on the head of the frame and thus return the tilted portion of the chair to the resting position once the user of the chair releases the rearward pressure.

The chair control device of the prior art generally includes a locking mechanism that includes a release lever and clutch mechanism made up of lamination plates for the purpose of seat angle adjustment as well as for backrest angle adjustment. These lamination packs are clamped between spacers and are locked force closed by a pressure element that can be activated manually by means of the release leaver.

In addition, the chair control device of the art generally includes a gas cylinder for the purpose of controlling the height of the seat of the chair. Generally the gas cylinder is operated by a release leaver by the user of the chair.

The following patents disclose various aspects of the chair control device of the prior art: U.S. Pat. No. 4,013,258 discloses a chair control for tiltable chairs including a simplified and strengthened mechanism with a stronger inner plate of the mechanism; U.S. Pat. No. 4,014,086 discloses a safety feature for chair control devices that includes an additional plate to protect the user in case of a broken bolt of the biasing means; U.S. Pat. No. 4,123,103 discloses a mechanism for a tiltable stenographer's chair including a biasing means made up of a U-shaped bolt with 2 helical springs to eliminate hand wheels; U.S. Pat. No. 4,253,632 discloses a base portion for a tiltable chair including a threaded cylindrical post secured to the chair control device includes an alignment means to align the tubular sleeve in a vertical position in an efficient manner as well as providing a novel bell assembly to facilitate easy adjustment and service of the chair; and U.S. Pat. No. 4,636,004 discloses a seat mounting for a swivel chair that include clutch type locking devices. In addition there exists various design patents showing aspects of tiltable chairs. These design patents include D252,786; D278,961; D246,217; D246,588; and D247,943.

SUMMARY OF THE INVENTION

Accordingly, it is an object of the present invention to at least partially overcome the disadvantages by providing a chair control device having an improved operative mechanism and overcoming failures of the extension from the housing for the seat locking cam means. To this end, the present invention provides an improved chair control device for tiltable chairs.

The present invention includes a chair control device for a tiltable chair wherein a portion of the chair tilts, said chair control comprising:

a) a one piece integral structure mainframe housing for supporting mechanisms, including an integral extension for the seat locking cam means that is an integral part of the housing;

b) a means to affix the one piece integral structure mainframe housing to a seat portion of the tiltable chair;

c) a seat locking cam means to control the amount of tilt in a specific range by locking the seat, said locking cam means comprising:

i. a clutch means to control the tilt function to lock the tilt into position; and ii. an adjustment means affixed to the locking cam clutch means; and d) a tension control means to control the resistance to the tilt motion comprising i. an elongated means having a first end attached to the mainframe and a second end attached to an adjustment means;

ii. an adjustment means affixed to the second end of the elongated bolt; and iii. a compression spring inserted on the shaft of the bolt between the adjustment means and the mainframe, wherein the tension control means is adapted to control the tension of the helical spring.

The present invention also includes a chair having a base portion, a seat portion, a back portion; and a chair control device including comprising:

a) a one piece integral structure mainframe housing for supporting mechanisms, including integral extensions extending therefrom; a means to affix the one piece integral structure mainframe housing to a seat portion of the tiltable chair; and b) a seat locking cam means to control the amount of tilt in a specific range by locking the seat, said locking cam means comprising i. a clutch means to control the tilt function to lock the tilt into position; and ii. an adjustment means affixed to the locking cam clutch means c) a tension control means to control the resistance to the tilt motion comprising i. an elongated means having a first end attached to the mainframe and a second end attached to an adjustment means;

ii. an adjustment means affixed to the second end of the elongated bolt; and iii. a compression spring inserted on the shaft of the bolt between the adjustment means and the mainframe, wherein the tension control means is adapted to control the tension of the helical spring.

BRIEF DESCRIPTION OF THE DRAWINGS

Further objects and advantages of the invention will appear from following description taken together with the following drawings in which.

DESCRIPTION OF THE PREFERRED EMBODIMENT

The present invention is directed to a tiltable chair that includes a base portion, a seat portion, a back portion and a chair control device shown generally as 20.

Figure 1:
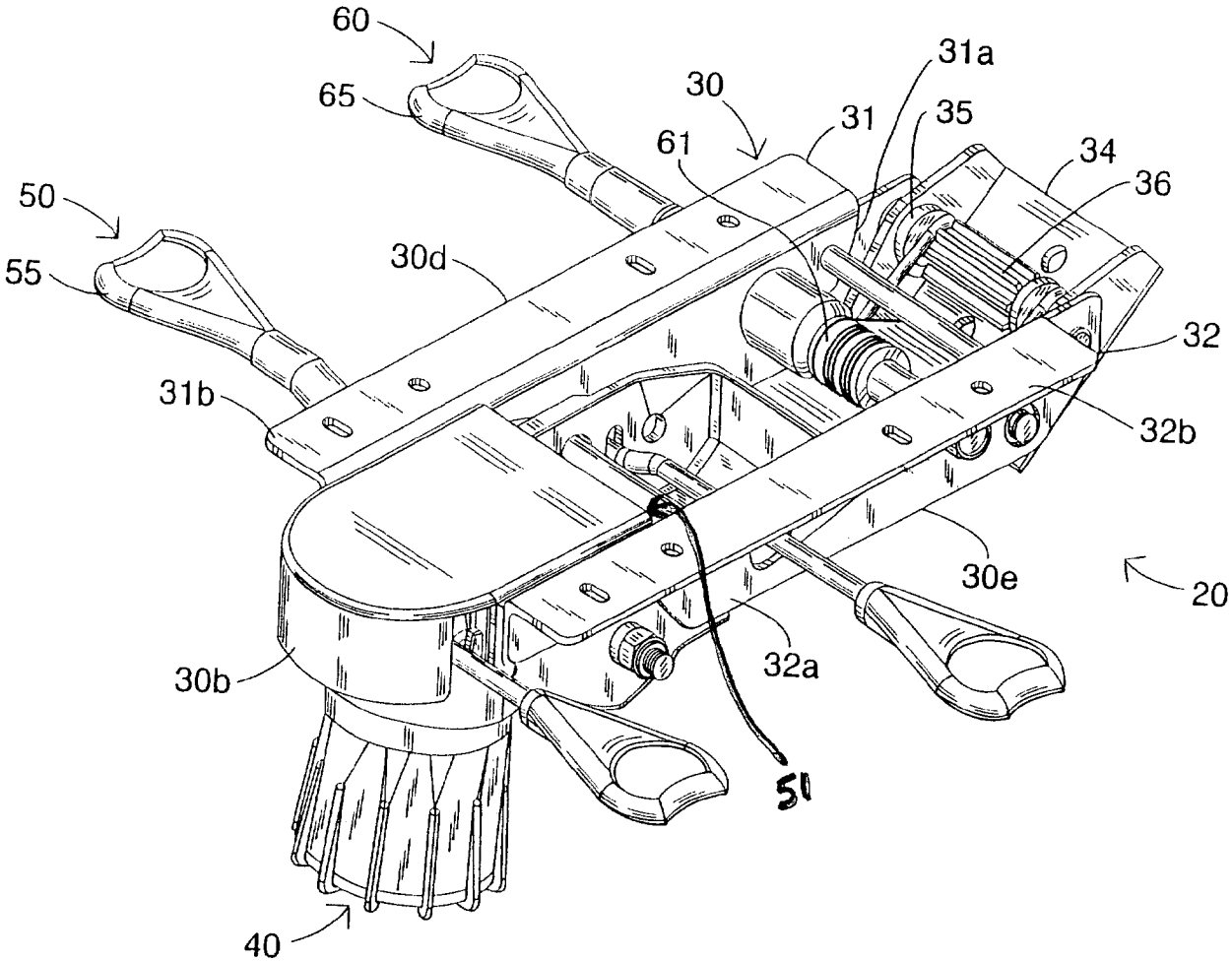
FIG. 1 is a three dimensional figure of the chair control device of the present invention.

As generally shown in FIG. 1, the chair control device 20 comprises a one piece integral structure mainframe housing 30, a pair of spider mounting brackets or rails 31, 32, a tension control means 40, a seat locking cam means 50, a tail piece bracket 34 to affix the pair of spider mounting brackets 31, 32 to the back portion of the chair and a back angle adjustment cam lock release means.

The mainframe housing 30 of the present invention is a casted housing made of aluminum type 380-alloy material. Other suitable materials include glass-reinforced nylon. The mainframe housing 30 is casted to have additional strength to withstand forces of operating the tiltable chair. In addition, the housing contains openings to allow for connections of other devices used in the chair control device 20 and an extension 30*f* shown in FIG. 3 for the seat locking cam means.

Figure 3:
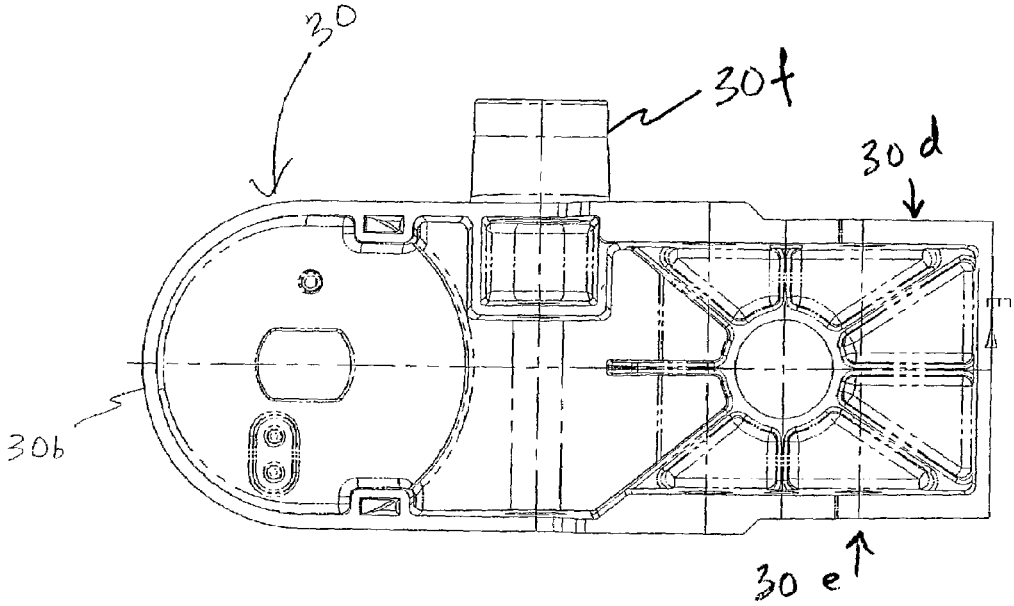
FIG. 3 is a cross-sectional view of the chair control device of the present invention.

For purposes of the preferred embodiment, the mainframe housing 30 has bottom portion 30*a*, rounded nose side 30*b*, backside 30*c* and two sides 30*d* and 30*e*. The bottom portion has openings for the tension control means and gas cylinder, and the two sides 30*d* and 30*e* have openings for miscellaneous bolts and appendages. As shown in FIG. 3, on side 30*d*, is an integral extension 30*f* of housing for a seat locking cam means. This integral extension provides for additional strength and avoids breakage of extensions that are welded onto the housing. In addition, the mainframe housing is reinforced on the topside with vertical components to provide additional strength.

In the preferred embodiment as described herein, the means to affix the mainframe housing 30 to the seat portion of a tiltable chair includes a pair of spider mounting brackets or rails 31, 32. Each spider mounting brackets 31, 32, is directly attached to opposite sides of the housing 30 and extend parallel to each other and along the longitudinal axis of the mainframe housing 30, as shown in FIG. 1. The brackets are affixed to the mainframe housing 30 by pins extending through the brackets and the housing 30. Each bracket 31, 32 is configured in a 90° angle such that the side portion of each bracket 31*a*, 32*a* lies against the side of housing 30 and the bottom portion 31*b* and 32*b* can be attached to the underside of the chair portion by a preferred attachment means of bolts. In the present invention, the brackets 31, 32 are made of steel although other materials can be used. In addition to affixing the mainframe housing 30 to the seat portion of the chair, the brackets 31, 32 also serve as support for other components of the chair control device 20 including the tension control means 40 and the seat locking cam means 50 and optionally, a back angle adjustment cam lock release means 60.

The one piece integral structure mainframe housing 30 is rotatably secured to the back portion of the chair by a tail bracket means 34 attached to the frame by a connecting means 35 extending from one side of the main frame to the opposite side of the main frame and affixed to each side of the frame. Encompassing the connecting means 35 is a spacer tensional spring 36 which functions to put tension on the rotation movement of the tail bracket means 34. The tail bracket means 34 is fixedly secured to the back portion by suitable means. A preferred means is three bolts.

Figure 2:
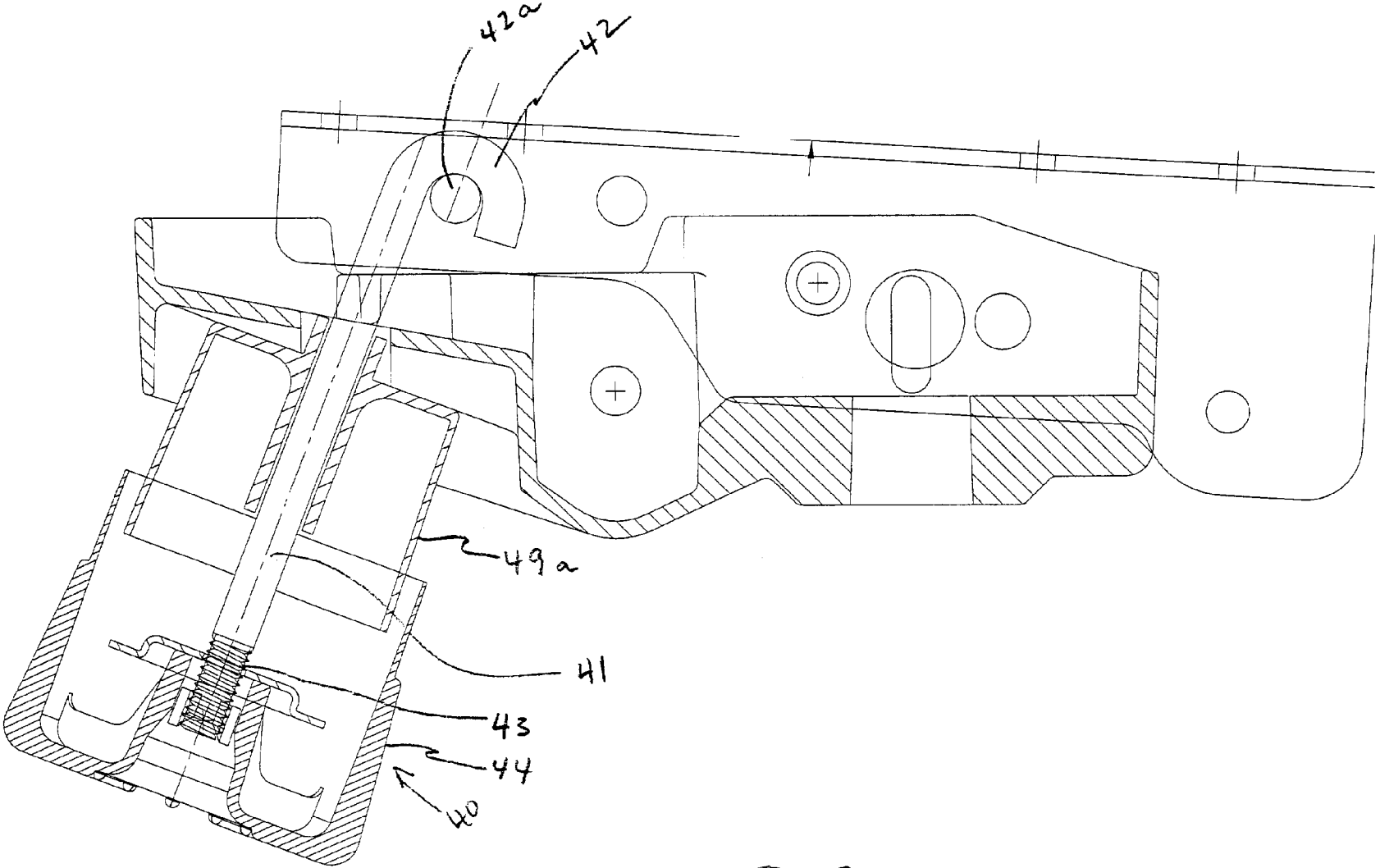
FIG. 2 is a side view of the chair control device of the present invention.

Affixed to the main frame 30 at the end opposed to the location of the tail bracket means 34, is the tension control means 40, shown on FIG. 2, which operates as a counterforce to the weight of the person sitting on the chair and allows the seat to tilt in a certain range which in the present embodiment is about 21° including about 18° backwards and 3° forwards. In particular, a user of lesser weight will require less counter force then a heavier person. The tension control means 40 as shown in FIG. 1, and in more detail in FIG. 2, includes an elongated bolt 41 having a first end having a hook end 42 and a threaded second end 43. The first hook end 42 is hooked around a tension control pin 42*a* extending from and through brackets 31 to and through bracket 32 such that the tension control pin 42*a* is secured between the two brackets 31, 32 and is located a fixed distance from the mainframe housing 30.

On the threaded second end 43 is threadedly screwed an adjustment hand wheel means 44 that is used to compress a helical spring by turning the hand wheel means 44. The helical spring extends between the hand wheel means 44 and the mainframe 30 having a first end located at the hand wheel means 44 and a second end located in the direction of the hooked end 42. Between the hooked end and the helical spring is a cover spring 49*a* into which the end of the helical spring fits. This end of the helical spring is fixed such that rotation of the hand wheel means compresses or releases the spring. The user of the chair can turn the hand wheel to control the amount of tension or resistance of the seat of the chair.

The seat locking cam means 50 is provided for the angular adjustment of the seat portion of the chair. It functions in either a fixed mode when the seat is locked into position or a free-floating mode. The seat locking cam means 50 includes the clutch means 51 and the adjustment means handle 55. The clutch means 51 is formed by a longitudinal pack of clutch plates. There may be 5 to 20 plates, preferably 10 to 15 plates. Their laminations are held together by a spacer and force closed against one another by means of the clamping pressure of a locking element. The locking element itself includes a cam which is secured by a pin which is mounted on the mainframe 30 and is controlled by the adjustment means handle 55. The clutch plates are provided between the mainframe 30 and a spacer. The spacer acts on one of these pressure plates in a forced closed fashion and it is only possible to shift this bracket from the pressure plate when force is applied at the adjustment handle means 55 which acts against the pressure of the springs.

The adjustment handle means includes a handle attached to the shaft, and when actuated, pushes the spacer in the direction away from the clutch plates.

The releasing means 60 is provided for the angular adjustment of the back portion of the chair and includes the clutch means 61 and the adjustment means handle 65. The clutch means 61 is formed by a longitudinal pack of clutch plates as shown in FIG. 1. There may be 5 to 20 clutch plates, preferably 10 to 15 clutch plates. The laminations are held together by a spacer and force closed against one another by means of the clamping pressure of a locking element. The locking element itself includes a cam which is secured by a pin, which is mounted on the spider 31 and is controlled by the adjustment means handle 65. The clutch plates are provided between the spider 31 and the spacer. The spacer acts on one of these pressure plates in a forced closed fashion and it is only possible to move this bracket from the pressure plate when force is applied at the adjustment handle means 65 which acts against the pressure of the springs.

The adjustment handle means includes a handle attached to the shaft, and when actuated pushes the spacer in the direction away from the clutch plates.

A gas cylinder is affixed to the bottom of the mainframe 30 for the purpose of controlling the height of the chair. In particular, the gas cylinder is affixed to a post extending down from the bottom of the seat portion of the chair and this gas cylinder is known to contain a release mechanism, an angular shaped lever can be pivoted in order to activate the mechanism. To release the gas spring, it is therefore necessary to move this lever against the pressure of the spring tensioning it, thereby pressing a throw provided on this lever against the release pin of the gas spring and keeping it pressed until the desired height of seat has been attained.

Although this disclosure describes and illustrates a preferred embodiment of the invention, it is to be understood that the invention is not restricted to this particular embodiment.

What is claimed is:

1. A chair control device for a tiltable chair, said chair control device comprising a) a one piece integral structure casted mainframe housing comprising an integral extension for a seat locking cam means;

b) a means to affix the one piece integral structure mainframe housing to a seat portion of the tiltable chair; and c) a seat locking cam means to control the amount of tilt in a specific range by locking the seat, said locking cam means comprising i. a first clutch means to control the tilt function to lock the tilt into position; and ii. a first adjustment means affixed to the locking cam clutch means d) a tension control means to control the resistance to the tilt motion comprising i. an elongated means having a first end attached to the mainframe and a second end attached to a second adjustment means;

ii. a third adjustment means affixed to the second end of the elongated means;

iii. a compression spring inserted on the shaft of the bolt between the adjustment means and the mainframe, wherein the tension control means is adapted to control the tension of a helical spring.

2. A chair control device of claim 1 further comprising a tailpiece bracket means to affix the mainframe to a back portion of the chair.

3. A chair control device of claim 1 further comprising a back angle adjustment cam lock release means for the back portion of the chair comprising i. a second clutch means to control the position of the back; and ii. an adjustment means affixed to the first clutch means.

4. A chair comprising the chair control device of claim 1, said chair comprising a) a seat portion;

b) a back portion; and c) gas lift means to control the height of the seat portion of the chair.

5. A chair of claim 4 wherein the chair control device further comprises a tailpiece bracket means to affix the mainframe to a back portion of the chair.

6. A chair of claim 4 wherein the chair control device further comprises a back angle adjustment cam lock release means for the back portion of the chair comprising i. a second clutch means to control the position of the back; and ii. an adjustment means affixed to the first clutch means.

7. A chair control device of claim 1 wherein the one piece integral structure mainframe housing further includes reinforcement.

* * * * *

UNITED STATES PATENT AND TRADEMARK OFFICE

CERTIFICATE OF CORRECTION

PATENT NO. : 7,017,992 B2
APPLICATION NO. : 10/368691
DATED : March 28, 2006
INVENTOR(S) : William Stumpf It is certified that error appears in the above-identified patent and that said Letters Patent is hereby corrected as shown below:

Front Page, Abstract

Line 2, the first "a" should be removed;

Line 9, "motion the tension control" should read -- motion. The tension control --;

Line 12, "inserted on the shaft" should read -- inserted in the shaft --;

Line 16, "locking of the seat, includes" should read -- locking of the seat includes --;

Line 17, "lock the tilt into position and an" should read -- lock the tilt into position, an --;

Line 18, "locking cam clutch and a" should read -- locking cam clutch, a --;

Line 20, "position of the back and an" should read -- position of the back, and an --;

Column 1

Line 12, "chair control device and a base" should read -- chair control device, and a base --;

Line 20, "chair control device" should read -- chair control devices --;

Line 47, "inserted on the free end" should read -- inserted in the free end --;

Line 57, "increased of reduced." should read -- increased or reduced. --;

Column 2

Line 5, "release leaver." should read -- release lever. --;

Line 9, "release leaver" should read -- release lever --;

Line 23, "device includes" should read -- device that includes --;

Line 27, "chair that include" should read -- chair that includes --;

Line 28, "In addition there exists various" should read -- In addition there exist various --;

UNITED STATES PATENT AND TRADEMARK OFFICE

CERTIFICATE OF CORRECTION

PATENT NO. : 7,017,992 B2
APPLICATION NO. : 10/368691
DATED : March 28, 2006
INVENTOR(S) : William Stumpf It is certified that error appears in the above-identified patent and that said Letters Patent is hereby corrected as shown below:

Column 3

Line 25, “inserted on the shaft” should read -- inserted in the shaft --;

Line 65, “housing 30 has bottom portion 30a,” should read -- housing 30 has a bottom portion 30a, --;

Line 67, “tension control means and gas cylinder,” should read -- tension control means and the gas cylinder, --;

Column 4

Line 3, “extension 30f of housing” should read -- extension 30f of the housing --;

Line 12, “Each spider mounting brackets 31, 32,” should read -- Each spider mounting bracket 31, 32, --;

Line 44, “means 40, shown on FIG. 2,” should read -- means 40, shown in FIG. 2, --;

Line 49, “less counter force then a heavier person.” should read -- less counter force than a heavier person. --;

UNITED STATES PATENT AND TRADEMARK OFFICE

CERTIFICATE OF CORRECTION

PATENT NO. : 7,017,992 B2
APPLICATION NO. : 10/368691
DATED : March 28, 2006
INVENTOR(S) : William Stumpf It is certified that error appears in the above-identified patent and that said Letters Patent is hereby corrected as shown below:

Column 6

Line 24, “of the elongated means;” should read -- of the elongated means; and --;

Line 25, “spring inserted on the shaft” should read -- spring inserted in the shaft --;

Signed and Sealed this

Ninth Day of June, 2009

JOHN DOLL
*Acting Director of the United States Patent and Trademark Office*